United States Patent [19]

Schliehe

[11] Patent Number: 4,656,762

[45] Date of Patent: Apr. 14, 1987

[54] ICE PREPARATION MACHINE FOR ICE TRACKS

[76] Inventor: Heinrich Schliehe, Zum Schlehenbusch 9, 4500 Osnabrück, Fed. Rep. of Germany

[21] Appl. No.: 734,384

[22] Filed: May 14, 1985

[30] Foreign Application Priority Data

May 19, 1984 [DE] Fed. Rep. of Germany ..... 8415366

[51] Int. Cl.[4] ..... E01H 5/09

[52] U.S. Cl. ..... 37/238; 198/699; 198/840

[58] Field of Search ..... 37/219, 222–223, 37/8, 237, 238–239, 249, 251, 252, 254, 256; 198/698, 696, 840

[56] References Cited

U.S. PATENT DOCUMENTS

| | | | |
|---|---|---|---|
| 1,547,276 | 7/1925 | Wentz | 198/699 |
| 1,708,376 | 4/1929 | Cook | 37/237 |
| 1,764,084 | 6/1930 | Nelson et al. | 37/237 |
| 2,375,065 | 5/1945 | Askue | 198/840 |
| 2,708,800 | 5/1955 | Logus | 37/239 X |
| 2,875,887 | 3/1959 | Hinchcliffe | 198/699 |
| 3,308,563 | 3/1967 | Danek | 37/237 |
| 3,622,205 | 11/1971 | Zamboni | 37/237 |
| 3,980,174 | 9/1976 | Conrad | 198/840 |
| 4,011,939 | 3/1977 | Conrad | 198/840 |
| 4,143,759 | 3/1979 | Paradis | 198/699 |

FOREIGN PATENT DOCUMENTS

| | | | |
|---|---|---|---|
| 1230560 | 9/1960 | France | 198/840 |
| 1362884 | 8/1974 | United Kingdom | 198/699 |

*Primary Examiner*—E. H. Eickholt
*Attorney, Agent, or Firm*—Michael J. Striker

[57] ABSTRACT

An ice preparation machine has a snow container, and a conveyor for transporting of snow removed from an ice surface into the snow container and formed as an inclined container including a belt drive provided with driving posts which are arranged centrally between screws transporting the snow.

8 Claims, 4 Drawing Figures

ICE PREPARATION MACHINE FOR ICE TRACKS

BACKGROUND OF THE INVENTION

The present invention relates to an ice preparation machine for ice tracks, with a conveyor for transporting snow removed from an ice surface into a snow tank.

Ice preparation machines of the above mentioned general type are used for smoothing of surface of ice tracks. The smoothing is performed by removing of ice chips by means of a cutter. The ice chips are identified in general as snow which is transporting by means of a conveyor into a snow tank of the ice preparation machine. The snow is first transported from the ice surface to the region of the center of the cutter by two oppositely rotating screws. The snow accumulated there is brought by a conveyor which is also formed as a screw, into the snow tank. This screw is arranged so that it is located vertical or approximately vertical, so that the conveyor can be identified as an inclined conveyor. During utilization of the ice preparation machine of this type it has been determined that it leads frequently to clogging of the screw which transports the snow into the snow tank. The cause of this is, on the one hand, the steep arrangement of the screw, and, on the other hand, the operation of the screw. A further critical point is the transfer of the snow by the screw from the central region of the cutter. When clogging takes place, its elimination leads to stoppage time.

SUMMARY OF THE INVENTION

Accordingly, it is an object of the present invention to provide an ice preparation which avoids the disadvantages of the prior art.

More particularly, it is an object of the present invention to provide an ice preparation machine of the above mentioned type, which makes possible transportation of snow into a snow tank with simple structural means without disturbances.

In keeping with these objects and with others which will become apparent herein after, one feature of the present invention resides, briefly stated, in an ice preparation machine for ice tracks which has a conveyor for transporting snow removed from an ice surface into a snow container, and the conveyor is formed as an inclined conveyor composed of a belt drive provided with a plurality of driving posts located between two screws which transport the snow.

By the formation of the conveyor as an inclined conveyor, the danger of clogging is reduced because of the reduction of inclination. The utilization of a belt drive is a simple, price favorable and first of all maintenance-free solution for the machine. The driving posts guarantee that the snow to be transported do not flow back opposite to the running direction of the belt drive. Because of the central arrangement of the belt drive, the effective length of the screws which transport the snow is reduced to a minimum value, and therefore it is guaranteed that no accumulation of snow on the snow ice surface in the region of the cutter takes place.

In accordance with an advantageous feature of the present invention, the belt drive is composed of a belt and at least two belt pulleys, the driving posts are mounted by means of mounting pieces arranged at the belt lower side facing toward the belt pulleys, and the belt pulleys are provided with recesses for passage of the mounting pieces. In this manner the driving posts are mounted in an especially simple manner without weakening of the belt.

In accordance with a further advantageous feature of the present invention, the belt is formed as a one-piece belt and has at its upper side which faces the driving posts a smooth surface, and its lower side several wedge webs which extend in the longitudinal direction of the belt and parallel to one another. In such a construction of the belt, it has a relatively great width so that the transporting volumes are sufficient for relatively great quantities of the snow to be transported. Since the belt is a one-piece member, a simple mounting is provided. The wedge-shaped webs impart to the belt the properties of a wedge belt which can transfer considerably higher forces than a flat belt.

The novel features of the present invention which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF A PREFERRED EMBODIMENT

Figure 1:
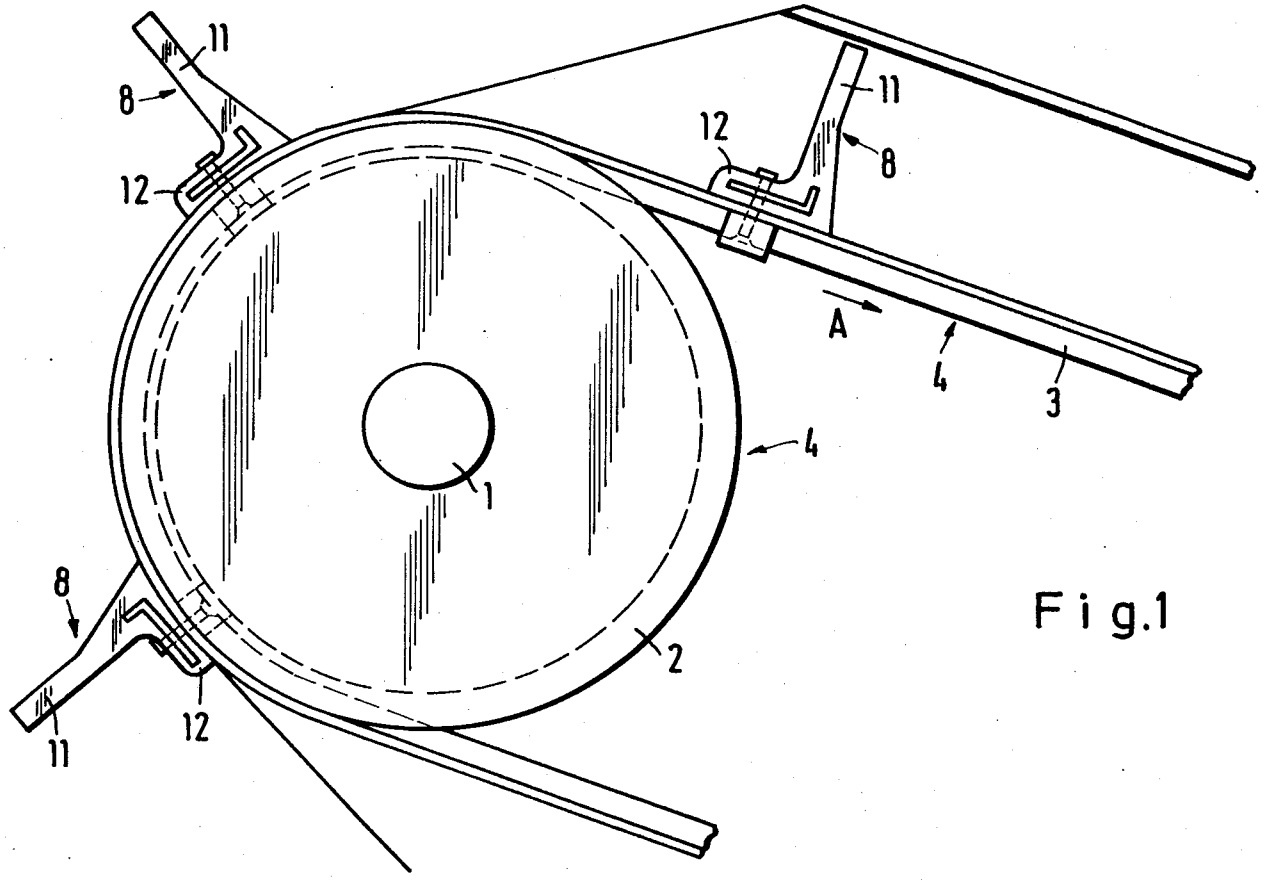
FIG. 1 is a schematic partial side view of a conveyor of an ice preparation machine in accordance with the present invention.
Figure 2:
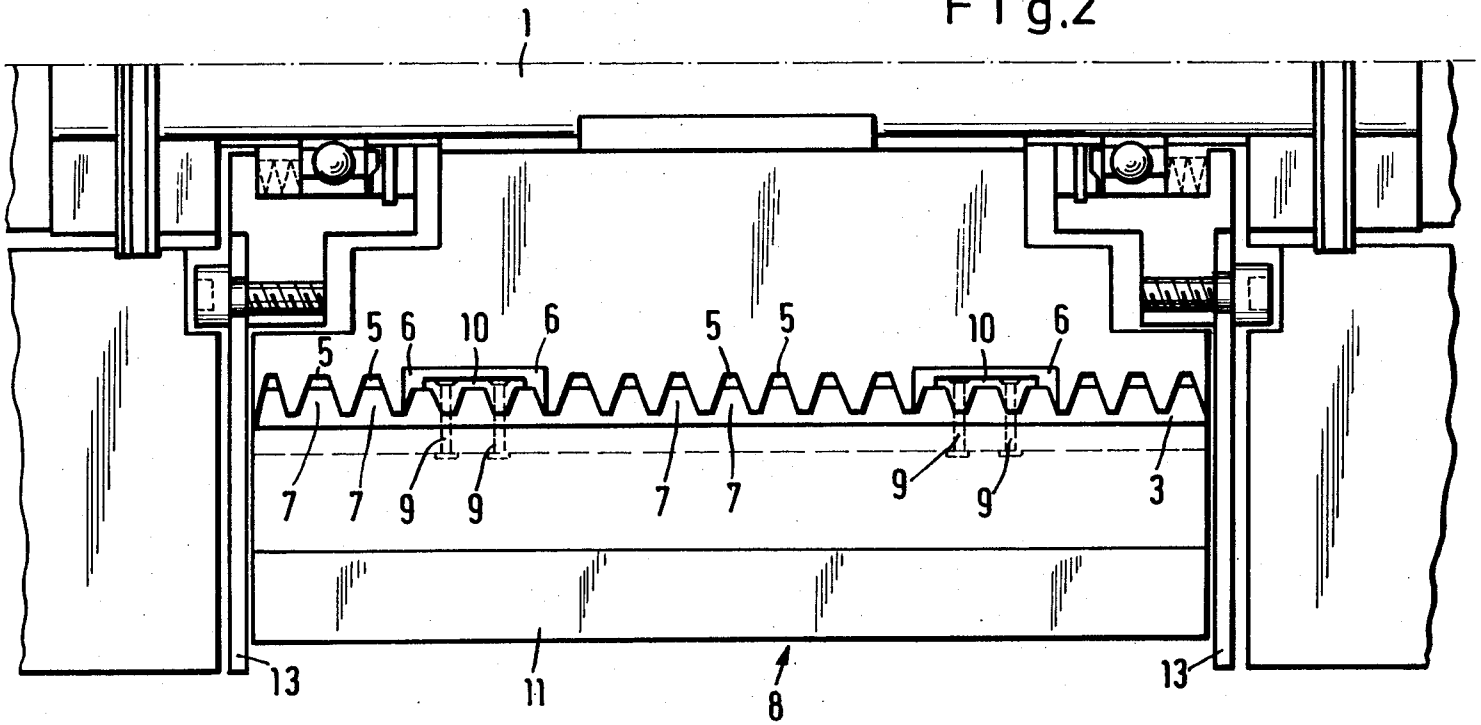
FIG. 2 is a plan view of the conveyor shown in FIG. 1.

FIGS. 1 and 2 show a part of a conveyor which lies above an ice surface to be prepared. A driving belt pulley 2 is supported on an axle 1 of the conveyor. The belt pulley 2 is a part of a belt drive 4 having a belt 3. A driven belt pulley as well as eventually available tensioning rollers are designed in the same manner as the belt pulley 2.

The belt pulley 2 has a relatively great rim width and is provided with a plurality of wedge shaped or trapezoidal grooves 5. In the region of each outer side the belt pulley 2 is provided with a circular ring-shape notch 6 which has a depth greater than the depth of the grooves 5. The belt 3 which also has a relatively great width is provided on its outer side with a smooth surface. Its inner side has however a plurality of wedge-shaped longitudinal webs 7 spaced from one another by distances corresponding to the distances between the grooves 5 of the belt pulley 2. The belt 3 can be considered as a plurality of wedge-shaped belts arranged near one another and mounted on an outer side of a flat carrier.

The outer side of the belt 3 is provided with a plurality of driving posts 8 which are arranged at a predetermined uniform distance from one another over the entire width of the belt. In the shown example they are mounted by screws 9 extending through the belt 3. A mounting piece 10 lying on the inner side of the belt 3 forms an abutment for each driving post 8. As can be seen from FIG. 2, each mounting piece 10 is provided with two webs which engage into associated grooves of the belt. Each mounting piece 10 lies during contact of the belt 3 with the respective belt pulley in a partial region of the annular notch 6. The running of the belt drive 4 is not affected by the annular notches 6, and a possibility of a stable mounting of the driving posts 8 is provided.

Each driving post 8 includes an angular profiled strip with a transport leg 11 extending normal to the belt 3 and a mounting foot 12 lying on the belt 3. The transport leg 11 in its region which faces towards the mounting foot 12 is formed with a greater wall thickness for increasing the stability. As can be seen from FIG. 1, the side which transports the snow extends from the center in inclined manner to the outer side of the belt 3. As can be seen from FIG. 2, stationary guiding sheets 13 are provided in the region of the side ends of the driving posts 8 so as to practically form a transporting passage. As also can be seen from FIG. 2, the width of the driving posts 8 is greater than the width of the belt 3 or the belt pulley 2.

During the operation of the ice preparing machine, the belt runs in the direction of the arrow A. The driving posts 8 pick up the snow in their lower position from the ice surface. As can be seen from FIG. 1, the straight runs of the belt drive 4 are inclined relative to a vertical line at an angle of about 22.5°.

Figure 3:
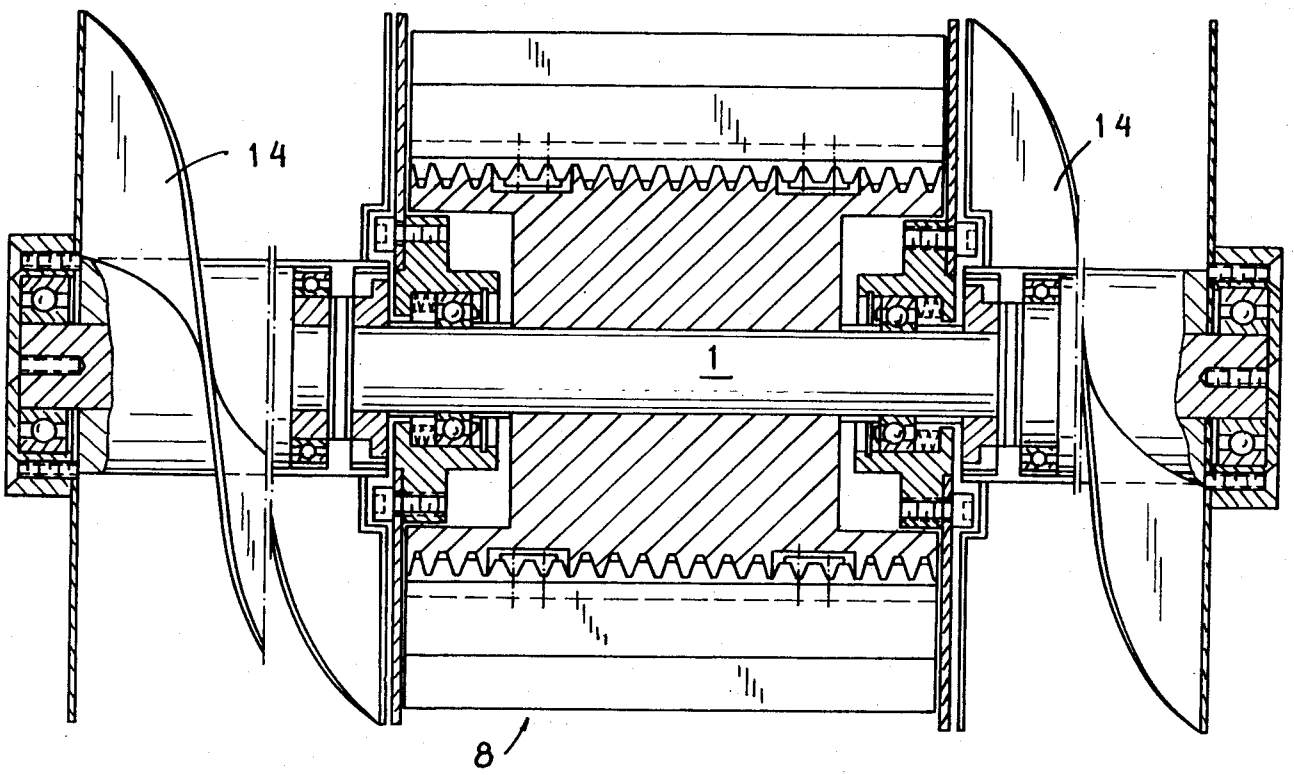
FIG. 3 is a more detailed plan view of the conveyor.

As can be seen from FIG. 3, two screws 14 are arranged at two opposite axial ends of the axis 1 and the belt pulley 2. The screws 14 transport the ice chips removed by the driving posts 11.

Figure 4:
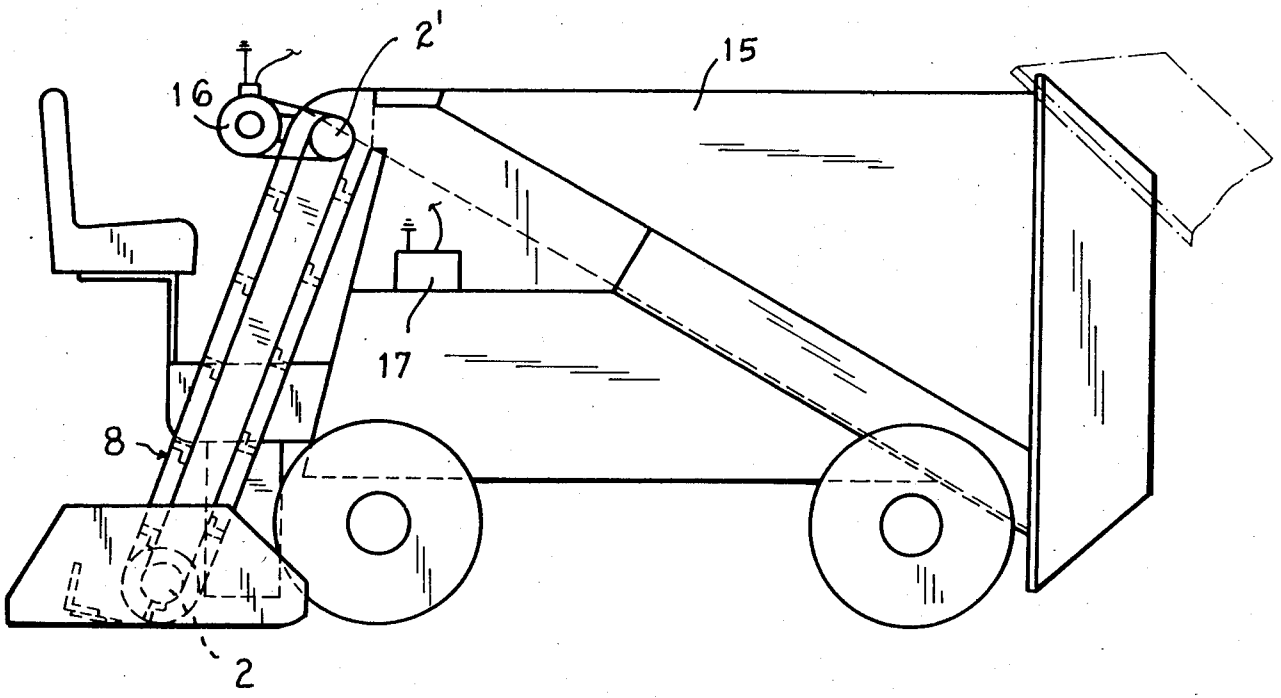
FIG. 4 is a view showing an ice preparation machine of the invention.

FIG. 4 schematically shows an ice preparation machine. The inclined conveyor transports the ice chips removed from the ice into a snow tank 15. The angle of inclination of the inclined conveyor is here about 15°. The upper end of the conveyor is formed as an elbow, so that the chips can change direction. The drive of the inclined conveyor is performed from a DC motor 16 which is supplied from an accumulator 17. A belt pulley 2' is driven by the motor 16 and located at the upper end of the conveyor. The belt is formed as a multiple-groove wedge-type belt.

The supporting posts 8 provided on the belt 3 transport the ice chips. The belt drive is located in the center of the ice removing tool, whereas the screws 14 are arranged at both ends of the ice removing tool, as shown in FIGS. 2 and 3. The drive of the screws 14 is performed from the motor which drives the belt.

It will be understood that each of the elements described above, or two or more together, may also find a useful application in other types of constructions differing from the types described above.

While the invention has been illustrated and described as embodied in an ice preparation machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An ice preparation machine for ice surfaces, comprising a snow container; a means for transporting snow from an ice surface into said snow container, said transporting means including a conveyor which is formed as an inclined conveyor which has a belt drive provided with a plurality of driving posts and transporting screws rotatable about horizontal axes for transporting the snow and arranged so that said belt drive is located centrally between said transporting screws, said belt drive having at least two belt pulleys and a one-piece belt with a lower side facing toward said belt pulleys, a plurality of mounting pieces arranged on said lower side of said belt and mounting said driving posts on said belt, said belt pulleys being provided with a grooved uniform surface and also with recesses in said surface, said belt having an upper side which faces toward said driving posts and is provided with a smooth surface, and said lower side of said belt being provided with a webbed mating uniform surface engaging said grooved uniform surface of said belt pulleys, and said mounting pieces passing through said recesses of said surface of said belt pulleys.

2. An ice preparation machine as defined in claim 1, wherein said driving posts are supported by said belt drive at uniform distances from one another and having lateral ends, said mounting pieces being arranged so that two of said mounting pieces fix each of said driving posts on said belt, and said recesses of said belt pulleys being arranged in the region of said lateral ends of said driving posts.

3. An ice preparation machine as defined in claim 1, wherein, said driving posts have an angular shape, each of said driving posts having a transport leg which extends normal to said belt and a mounting foot which lies on said belt.

4. An ice preparation machine as defined in claim 3, wherein said transport leg of each of said driving posts has a cross-section increasing in direction toward said belt.

5. An ice preparation machine as defined in claim 1, wherein said belt has lateral sides; and further comprising guiding sheets arranged at said lateral sides of said belt and forming therewith a transporting passage.

6. An ice preparation machine as defined in claim 1; and further comprising means for driving said belt drive in rotation; and means for transmitting the rotation of said belt drive to said transporting screws so that said transporting screws are driven by said belt drive.

7. An ice preparation machine as defined in claim 6, wherein said belt pulleys have an upper belt pulley and a lower belt pulley, said upper belt pulley being driven by said driving means, said lower belt pulley being driven from said upper belt pulley via said belt, said transmitting means having an axle which both supports said lower belt pulley and said transporting screws.

8. An ice preparation machine as defined in claim 1, wherein each of said belt pulleys has an axis and each of said grooved uniform surfaces of said belt pulleys has a plurality of wedge-shaped grooves uniformly distributed in an axial direction, said mating uniform surface of said belt having a plurality of wedge-shaped webs uniformly distributed in an axial direction and engageable into said wedge-shaped grooves of said belt pulleys, said mounting pieces having surfaces which are also provided with wedge-shaped grooves into which said wedge-shaped webs of said belt are engageable.

* * * * *